United States Patent [19]

Kosmowski

[11] 4,194,698

[45] Mar. 25, 1980

[54] SHREDDER

[75] Inventor: Wojciech Kosmowski, Fountain Valley, Calif.

[73] Assignee: American Delphi, Inc., Westminster, Calif.

[21] Appl. No.: 926,798

[22] Filed: Jul. 21, 1978

[51] Int. Cl.[2] ..... B02C 18/00; B02C 18/06

[52] U.S. Cl. ..... 241/236

[58] Field of Search ..... 241/236, 235, 243, 242, 241/296, 292.1, 227; 83/500, 664, 665, 425.3

[56] References Cited

U.S. PATENT DOCUMENTS

| | | | |
|---|---|---|---|
| 2,036,207 | 4/1936 | Feddern et al. | 241/236 |
| 3,960,335 | 6/1976 | Haberle | 241/236 |
| 4,034,918 | 7/1977 | Culbertson et al. | 241/236 |

FOREIGN PATENT DOCUMENTS

| | | | |
|---|---|---|---|
| 819616 | 11/1951 | Fed. Rep. of Germany | 241/236 |
| 458388 | 10/1913 | France | 241/236 |
| 329147 | 9/1972 | U.S.S.R. | 241/236 |

*Primary Examiner*—Richard B. Lazarus

*Attorney, Agent, or Firm*—Fulwider, Patton, Rieber, Lee & Utecht

[57] ABSTRACT

A shredding device is provided in which counterrotating parallel shafts carry interleaved cutting disks thereon. The rim of each cutting disk is of concave cross section so that cutting blade edges of acute angles are formed at the perimeter of each flat transverse surface of each disk. Also, a plurality of transverse grooves or notches are formed spaced along the rim of some of the disks. Cutting and shredding of material fed to the counterrotating disks is improved by virtue of the sharper blade cutting edges and because the notched disks tend to grab the material to be cut and forcibly draw it against the cutting edges of the counterrotating disks.

8 Claims, 6 Drawing Figures

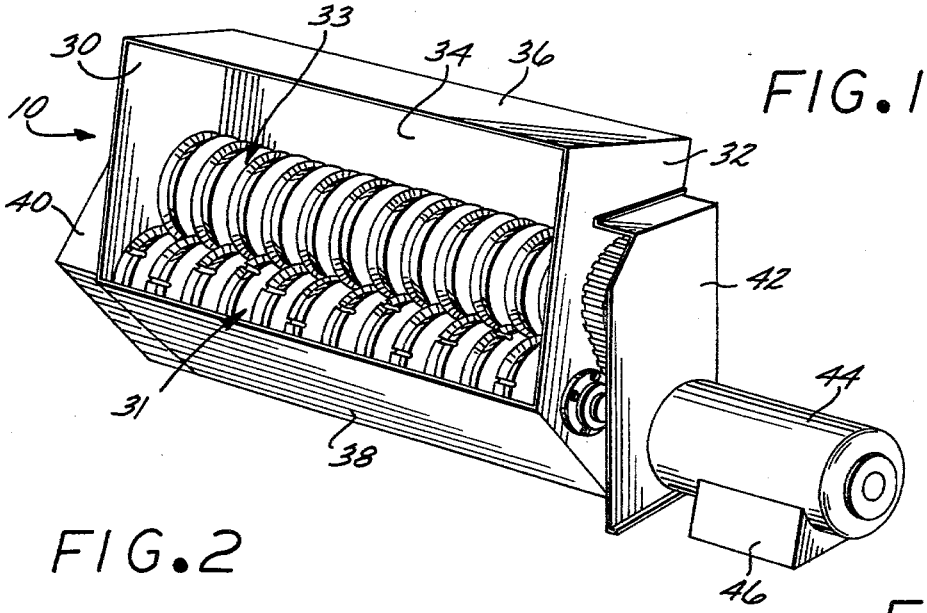
FIG. 1
FIG. 2
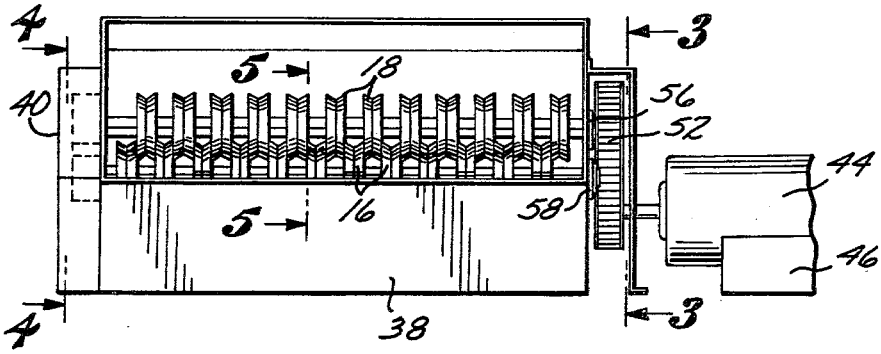
FIG. 3
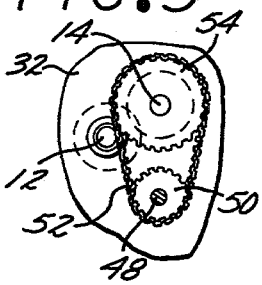
FIG. 4
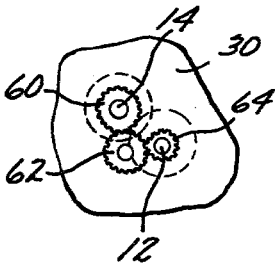
FIG. 5
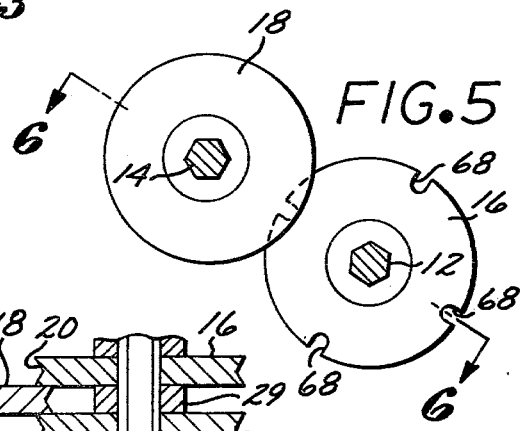
FIG. 6
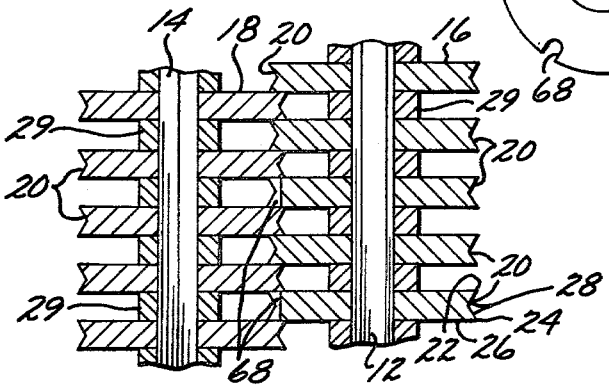

SHREDDER

BACKGROUND OF THE INVENTION

1. Field of the Invention

The present invention relates to shredding devices and particularly to shredders adapted for use to shred large volumes of paper.

2. Description of the Prior Art

In the past various types of paper shredding devices have been devised. Most paper shredders employ counterrotating rolls having a plurality of interleaved cutting elements, typically in the form of toothed or spiked disks separated from each other along one of two parallel shafts by spacer elements mounted between them. Alternatively, smoothed surfaced disks of right cylindrical configuration have been similarly arranged in an interleaved manner to effectuate shredding of fiberous or matted material. However, the prior devices of this type have suffered from several fundamental deficiencies.

While adequate for relatively small quantities of paper, such as waste paper typically collected from office building waste baskets, the paper shredders of prior construction are totally inadequate for the requirements of modern offices. With the advent and increased use of high speed printing devices, such as computer printers and high speed reproducing machines, large stacks of wastepaper must be disposed of daily from commercial buildings. Because such large volumes of paper arrive at the shredders location in relatively neat stacks with a large mass of paper in a very compact volume, the techniques of prior paper shredding devices are unworkable. The toothed or spiked projections of conventional paper shredders simply cannot puncture and then tear such large stacks of computer paper, as is possible with isolated letters, notepads, and other wastepaper debris historically consumed in business office operations. When confronted with stacks of computer print-out paper to be shredded, the grinding teeth of conventional paper shredders merely draw the paper into the counterrotating rolls, whereupon the shredder jams. Paper james of this type also occur in conventional shredders employing counterrotating right cylindrical disks designed to shear waste paper into strips. Moreover, because stacks of computer print-out paper and other large volumes of paper discarded in stacks do not arrive at the shredder in a jumbled array, the stacks, or portions thereof, tend to slide across the counterrotating disks without being cut. Eventually, thick pads of paper are thrown sideways between adjacent counterrotating disks, which then slide past the paper without cutting it. Paper wedged between shearing disks inhibits the rotation of the disks and presents paper blockages of another type.

SUMMARY OF THE INVENTION

One object of the present invention is to provide a shredding device capable of effectively slicing, tearing and processing thick stacks of paper in a shredding operation while reducing the occurrence of paper jams. Because of their relatively great thickness, the counterrotating disks of the present invention are able to withstand the large stresses developed in disposing of stacks of paper several inches in thickness. Due to the unique cross sections of the rims of these disks the shredder is able to more effectively cut the paper and prevent it from being passed intact through the counterrotating rolls to cause paper blockages, as typically occurs in conventional devices. By forming the rims of the cutting disks in a concave cross section, sharp blade edges are formed on either side of the disk. This contrasts with conventional right cylindrical shearing disk construction in which the apex of the cutting edge is formed in a 90° angle on either side of the disk, or in which the thickness of the disk is narrowed at its periphery to a single thin blade edge.

A further object of the invention is to provide a paper shredding apparatus capable of grabbing quantities of stacked paper to draw the paper between counterrotating rolls, but without developing paper jams as typically occur in conventional devices. Paper shredders of prior construction have been able to effectively receive and shred stacks of paper only up to about ½ inch in thickness. Furthermore, even this thickness frequently jams these prior devices. In contrast, the shredder of the present invention is able to effectively shred stacks of computer paper 2 inches in thickness at a time.

A further object of the invention is to provide a device which will shred other materials which are difficult to process for disposal. The shredder works effectively to shear and tear stacks of newspaper and also cardboard, both of which have been extremely difficult to shred in the past. Furthermore, the shredder of the invention is reasonable effective on glossy, high clay content picture paper, which is used in some magazines

DESCRIPTION OF THE DRAWINGS

FIG. 1 is a perspective view of a shredder constructed according to the present invention.

FIG. 2 is a front elevational view of the shredder of FIG. 1.

FIG. 3 is an end view of the cutter drive train taken along the lines 3—3 of FIG. 2.

FIG. 4 is a view of the opposite end of the engagement gears of the intermeshed cutter rolls, taken along the lines 4—4 of FIG. 2.

FIG. 5 is an enlarged view of a pair of counterrotating disks taken along the lines 5—5 of FIG. 2.

FIG. 6 is an enlarged view of a plurality of interleaved disks taken along the lines 6—6 of FIG. 5.

DESCRIPTION OF THE INVENTION

FIG. 1 illustrates a floor or table mounted shredding apparatus indicated generally at 10 and employing a pair of counterrotating shafts 12 and 14, visible in FIGS. 3 and 4. A plurality of steel cutting disks 16 and 18, indicated in FIG. 6, are mounted at longitudinally spaced intervals along the shafts 12 and 14 in interleaved arrangement wherein the outer perimeters or the rims 20 of each cutter overlap with those of adjacent cutting disks on the opposite shaft. The rim 20 of each of the disks 16 and 18 is of a concave cross sectional configuration, preferably of the V-shaped profile depicted in FIGS. 2 and 6. With reference to FIGS. 2 and 6. With reference to FIGS. 2 and 6, it can be seen that the blade edges 22 and 24 are formed at the intersections of the planar transverse surfaces 26 on opposite sides of each of the disks with the inclined curved frustum surfaces at 28. These intersecting surfaces define cutting blades of acute angles in profile at the perimeter of each of the opposing surfaces 26 of each cutting disk 16 and 18.

Between the disks 16 and between the disks 18 metal spacers 29 are provided to separate adjacent disks on each of the shafts 12 and 14. Each assemblage of disks and separating spacers 29 form a cutting roll. As is apparent in FIGS. 3 and 5, the shaft 14 is located above and to the rear of the shaft 12 so that the roller 33 is at an angle elevated about 45° from the horizontal with respect to the roll 31.

The counterrotating cutting rolls 31 and 33 of the shredding device 10 are encompassed within a sheet metal housin depicted in FIG. 1 and having generally vertical end walls 30 and 32, an upright back wall 34, a generally lateral top 36, and an inclined planar partition 38 extending about half way up the front of the enclosure housing as depicted in FIGS. 1 and 2. Typically, a belt conveyor (not shown) is arranged in horizontal alignment with the upper edge of the partition 38 to feed paper to be shredded into the housing between the end walls 30 and 32 and above the inclined partition 38 in a direction perpendicular to the orientation of the longitudinal cutter shafts 12 and 14. The conveyor is operated at a predetermined feed rate consistent with the speed of the counterrotating cutter disks 16 and 18 and consistent with the thickness and overall quantity of paper or other material to be shredded.

on the outsides of the end walls 30 and 32, protective sheet metal coverings 40 and 42 are arranged in upright disposition to shelter the drive train and intermeshing gears which are used to operate the shredding device 10. As indicated in FIG. 1, an electrical motor 44 oriented with a rotating horizontally disposed shaft 48 extending through the guard partition 42 is used to drive the cutter rolls 31 and 32 in counterrotation. The motor 44 is stabilized by a mounting block 46 which has a concave upper surface to receive the body of the motor housing.

As indicated in FIG. 3, the cylindrical horizontally extending motor shaft 48 has a conventional spur gear 50 keyed thereon to rotate in a vertical plane between the vertical end wall 32 and the upright guard partition 42 of the shredder 10. The spur gear 50 drives an endless chain link belt 52, illustrated in FIGS. 2 and 3, which in turn rotates another spur gear 54 of larger diameter than the gear 50 in coplanar arrangement, as illustrated in FIG. 3. The gear 54 is keyed to the shaft 14, which in turn extends through a bearing mount 56 to the interior of the shredding aparatus 10. The shafts 12 and 14 are of hexagonal cross sectional configuration throughout the major portions of their lengths to facilitate the mounting of the cutting disks 16 and 18 in keyed arrangement thereon. However, at the shaft extremities, the shaft 12 and 14 are both of cylindrical configuration so that they are able to rotate within conventional annular bearing races 56 and 58 visible in FIG. 2.

The shafts 12 and 14 are coupled together at their extremities remote from the motor 44 and exterior to the opposite vertical end wall 30 of the shredding apparatus 10 by an interlocking gear arrangement depicted in FIG. 4. Specifically, a spur gear 60 is secured to the shaft 14 external to the end wall 30 and within the confines of the upright metal covering 40, and rotates in engagement with an idler spur gear 62. The gear 62, in turn, engages another spur gear 64 keyed to the shaft 12 on the outside of wall 30. By employing the idler gear 62 in this fashion, counterrotation between the rolls 31 and 33 and between the cutting disks 18 and 16 is effectuated. The gear 62 is preferably the same diameter as the gear 60, and the gear 64 is about two thirds this diameter so that the cutting disks 16 are rotated at about one and one half-times the speed of the cutting disks 18. Preferably, the cutting disks 18 are rotated at a speed of about 24 rpm while the cutting disks 16 are rotated at a greater speed, about 36 rpm.

The arrangement of the gears 16 and 18 is depicted in FIG. 6. The cutting disks 16 and 18 are each about 8 ½ inches in diameter and about 1 inch in thickness. The cutting disks 16 are arranged along the shaft 12 and the cutting disks 18 are arranged along the shaft 14 at spaced intervals of about 1.005 inches. Adjacent cutting disks are separated by the metal spacers 29 which are located in alternation between the cutting disks. This allows a clearance of 0.0025 inches on each side of the overlapping portion of each of the cutting disks 16 and 18. The dovetail V-shaped rims 20 form a concave angle of 120° at the center of each disk so that the acute angles of the blade edges 22 and 24 are each about 30°.

All of the cutting disks 16 mounted upon the shaft 12 have a plurality of transverse grooves or notches 68 of U-shaped configuration. The notches 68 are of uniform cross section across the width of the disks 16. Preferably, the distance of a cord across each of the grooves 68 is at least ¼ of 1 inch. That is, the gap in the surface of the rim 20 is preferably at least ¼ of 1 inch. That is, the gap in the surface of the rim 20 is preferably at least ¼ of 1 inche across.

In the operation of the invention, paper, frequently in stacks of up to 2 inches in thickness, is fed laterally into the opening in the shredding apparatus 10 above the partition 38 where it is received between the cutting disks 16 and 18. The cutting disks 16 rotate at a greater speed than the cutting disks 18 and tend to grab or snag portions of the paper and draw it between the counterrotating cutting disks 16 and 18. Because of the concave configuration of the rims 20 of the cutting disks 16 and 18, sharp cutting blade edges are formed along the edges 22 and 24 of the rim perimeter ar the intersection of the rim with the opposing faces 26 of the cutting disks. Because the cutting disks 16 and 18 are of substantial thickness, the disks 16 and 18 do not deflect significantly despite large stresses which are placed on them in processing great thicknesses of paper. As a result, the clearances between adjacent ones of the counterrotating disks are maintained at the design tolerances so that paper is effectively and consistently sheared by the cutting edges 22 and 24 of the disks 16 and 18 as the paper is drawn thereto.

As paper is fed into the shredder 10, portions of the paper are forced into the notches 68 and lodge therein. The paper is thereby grasped by the cutting disks 16 so that it is more firmly drawn against the cutting edges 22 and 24, both of the cutting disks 16 upon which it is snagged and of the cutting disks 18. As a consequence, it is possible to more easily shred thick stacks of paper since the shearing forces necessary to cut the paper stacks are reduced because of the effective application of the shearing force. The shredded strips of paper pass downward and to the rear in the interstitial spaces between the rims 20 of the cutting disks 16 and 18 and the opposing spacers 29 mounted upon the shaft opposite thereto. The paper shreds are then expelled through an opening in the lower portion of the back wall 34 of the shredder housing. Due to the unique cutting disk structure, less force is required to shear a given thickness of paper, so that the shredding device is able to accomodate significantly thicker stacks of paper as contrasted with prior art devices. Also, because the paper is drawn directly against the cutting edges, the shredder 10 can be operated for a much longer period of time before blade sharpening is required, as contrasted with prior art devices.

While but a single embodiment of the invention is depicted, it should be understood that various modifications and alterations of the structure of the invention will become readily apparent to those familiar with paper shredders and cutters. Accordingly, the invention should not be construed as being limited to the specific structure of the embodiment depicted herein, but rather is defined in the claims appended hereto.

I claim:

1. In a shredding apparatus employing a pair of counterrotating shafts each having a plurality of disks mounted thereon at spaced intervals in interleaved arrangement each disk having opposing transverse faces with an encircling rim the improvement wherein the rim of each said disks is configured in a V-shaped cross section, thereby forming arcuate blade edges of acute angles at the perimeter of each of said transverse faces, and four equally spaced notches of U-shaped configuration of uniform cross section throughout deeper than the V-shaped rim configuration are defined through the blade edges of each of the disks mounted on a single one of said shafts, which is geared to rotate at a greater speed than the other of said shafts.

2. Apparatus according to claim 1 further characterized in that the acute angles of said blade edges are about 30°.

3. In a device for shredding material between counterrotating interleafed parallel shearing disks, mounted on separate parallel rotating shafts, the improvement wherein each disk has planar circular parallel congruent faces a rim of V-shaped configuration which forms arcuate cutting edges at the intersections of said rim with said faces, and four equally spaced notches each having a U-shaped configuration in the planes of said disk faces deeper than the V-shaped rim configuration defined in all of said disks of a single one of said shafts and said notches are of uniform cross section throughout and said shaft upon which said notched disks are mounted is geared to rotate at a greater speed than the other of said shafts.

4. Apparatus according to claim 3 further characterized in that said disks are solid structures each about one inch thick.

5. Apparatus according to claim 4 further characterized in that said disks are mounted on a pair of parallel shafts, and all of said disks mounted on one shaft each have a plurality of transverse grooves defined therein, and the length of a chord across each of said grooves is at least one quarter of one inch.

6. Apparatus according to claim 5 further characterized in that said shaft with grooved disks is rotated about one and one half times as fast as the other shaft.

7. Apparatus according to claim 6 further characterized in that said shaft with grooved disks is rotated at a speed of about 36 revolutions per minute and said other shaft is rotated at a speed of about 24 revolutions per minute.

8. Apparatus according to claim 3 further characterized in that the clearance between adjacent ones of said interleaved disks is about 0.0025 inches.

* * * * *